US007788854B2

(12) United States Patent
Friedman et al.

(10) Patent No.: US 7,788,854 B2
(45) Date of Patent: Sep. 7, 2010

(54) ELEVATOR ENTRANCE DOOR SILL PIVOTABLE INTO AND OUT OF ELEVATOR SHAFT VIA HINGE CONNECTED SUPPORT AND ALIGNMENT BRACKETS

(75) Inventors: Harold S. Friedman, 7 Gracie Sq., New York, NY (US) 11377; Jeffrey Freidman, New York, NY (US); Walter Guslawski, Bronz, NY (US); George Karazim, Hicksville, NY (US)

(73) Assignee: Harold S. Friedman, New York, NY (US)

( * ) Notice: Subject to any disclaimer, the term of this patent is extended or adjusted under 35 U.S.C. 154(b) by 860 days.

(21) Appl. No.: 11/216,985

(22) Filed: Aug. 31, 2005

(65) Prior Publication Data

US 2006/0054419 A1 Mar. 16, 2006

Related U.S. Application Data

(63) Continuation-in-part of application No. 10/233,277, filed on Sep. 3, 2002, now Pat. No. 6,938,380.

(51) Int. Cl.
*E06B 1/70* (2006.01)

(52) U.S. Cl. ..... 52/30; 49/468

(58) Field of Classification Search ..... 52/656.1, 52/656.4, 656.2, 29, 30; 49/467, 468; 16/389, 16/390; 187/313, 325, 333
See application file for complete search history.

(56) References Cited

U.S. PATENT DOCUMENTS

| | | | | |
|---|---|---|---|---|
| 1,529,122 | A * | 3/1925 | Fischer | 187/400 |
| 3,382,631 | A * | 5/1968 | Halpern | 52/211 |
| 3,601,938 | A * | 8/1971 | Loomis | 52/29 |
| 5,609,224 | A * | 3/1997 | Baggot | 187/313 |
| 5,706,913 | A * | 1/1998 | Rivera | 187/334 |
| 5,715,913 | A * | 2/1998 | De Jong | 187/334 |
| 6,145,630 | A * | 11/2000 | Friedman et al. | 187/313 |
| 6,247,559 | B1 * | 6/2001 | Ach | 187/414 |
| 6,684,573 | B2 * | 2/2004 | Heath et al. | 49/467 |
| 2006/0175147 | A1 * | 8/2006 | Morotome et al. | 187/400 |
| 2006/0243534 | A1 * | 11/2006 | Miller et al. | 187/313 |

* cited by examiner

*Primary Examiner*—Gay Ann Spahn

(57) ABSTRACT

An elevator entrance sill assembly and method of installing and leveling of an elevator sill are provided. An elevator entrance sill assembly is provided for mounting at the elevator entrance adjacent to the elevator shaft. The sill is mounted to a support assembly which provides the necessary stiffness to prevent the sill from flexing. Hinge supports are attached to the sill assembly and mounted on the building floor adjacent to the elevator shaft and rotatable to extend upwardly from the floor and out of the elevator shaft. The door sill assembly is attachable to the hinge support while in the upward or vertical position out of the elevator shaft. The hinge support and the sill assembly are rotatable downwardly to a horizontal position on the floor after attachment of the sill assembly to the hinge support with the sill assembly extending into the elevator shaft.

8 Claims, 9 Drawing Sheets

ELEVATOR ENTRANCE DOOR SILL PIVOTABLE INTO AND OUT OF ELEVATOR SHAFT VIA HINGE CONNECTED SUPPORT AND ALIGNMENT BRACKETS

FIELD OF INVENTION

The present invention relates to building construction and more particularly to an advantageous elevator entrance sill structure and installation method that allows for complete installation from the hallway without the use of a moving elevator platform. This application is a Continuation-in-Part of application Ser. No. 10/233,277 filed date Sep. 3, 2002 now U.S. Pat. No. 6,938,380.

BACKGROUND OF INVENTION

A number of structures and methods are known and commonly used to install an elevator entrance sill including the following:

"sill support pocket". This method is typically used in a building where the structural method of support is poured concrete. The concrete hall floor slab extends into the shaft and a pocket approximately 2" to 3" deep must be created in the top edge of the slab inside the elevator shaft in the opening A where the entrance is to be located. Making a pocket is a time consuming and costly procedure. The sill is fastened to this pocket by means of adjustable brackets and eventually the whole entrance is mounted on top of the sill. There are a number of common problems with this cumbersome and inefficient method:

(a) When the floor is poured, the contractor forgets to build the pocket into the form used to shape the floor slab. The concrete must then be chopped out manually, a time consuming and inaccurate process.

(b) The pocket is formed unevenly or inaccurately because the tolerances for pouring concrete are much larger than those in entrance installation. Installation now takes longer to adjust the entrance components and specially made parts may be required.

(c) Because the sill adjustment angles leave a large empty space under the sill, cement must be poured under the sill in order to minimize deflection when a heavy load is run over the sill or from sagging over time due to traffic. If the sill is allowed to bend too much the doors can come out of their tracks and fall off the entrance, leaving an open shaft.

"sill support angle". This method is typically used in a building where the structural method of support is steel. Since the floor slab does not extend into the shaft, L-shaped structural steel angles are bolted into the shaft wall a few inches below the floor at each opening. The sill is then mounted on this angle using adjustable brackets. The most significant disadvantage is that this can only be done from a running elevator platform (when the elevator's mechanical and electrical systems are installed). This presents the following problems:

a. Using the running elevator platform for sill support angle installation prevents other trades from using it. The elevator construction company cannot make any adjustments on the elevator's performance, nor can the platform be used to bring other material up and down within the building.

b. When the platform is being used the elevator company cannot work in the shaft.

c. Trade union regulations require that only a qualified operator can operate the platform, but this operator cannot assist in installing the sill support angles, thereby adding extra cost to the entrance installation.

d. Because the sill adjustment angles leave a large empty space under the sill, cement must be poured under the sill in order to minimize deflection when a heavy load is run over the sill or from sagging over time due to traffic. If the sill is allowed to bend too much the doors can come out of their tracks and fall off the entrance, leaving an open shaft.

"continuous strut/beckett system". This method of erection can be used in any type of building. Sections of struts, U-shaped or L-shaped channels, are spliced together to run continuously the whole height of the shaft parallel to the elevator rails, one strut on either side of the entrance opening. The struts are bolted to the wall periodically to allow them to hold the entire weight of the entrance assembly. Just below the opening at each floor, a sill mounting channel is installed horizontally and fastened to each strut. This sill is then installed on this channel and adjusted to the correct height. The primary problem with this method is that the struts and the sill mounting channel can only be installed from inside the shaft. As mentioned in the "sill support angle" description, this presents the following problems which increase expense and complexity:

a. Using the running elevator platform for sill support angle installation prevents other trades from using it. The elevator construction company cannot make any adjustments on the elevator's performance, nor can the platform be used to bring other material up and down within the building.

b. When the platform is being used the elevator company cannot work in the shaft.

Accordingly there has been a need for a simple, inexpensive structure and method of sill installation that overcomes the above disadvantages.

SUMMARY OF THE INVENTION

In accordance with the principles of the present invention, the shortcomings of the aforementioned construction of an elevator entrance door sill assembly and installation method have been overcome through a new and improved sill assembly and installation process.

The QuickSill ™ elevator entrance sill structure and installation method is an alternative elevator entrance sill support system. While advances in building construction methodology and hi-tech products have dramatically decreased the time frame associated with erecting today's High-rise structures, elevator entrance installation has been left behind the times. It is no secret that the elevator contractors cannot keep up with the pace of building in today's market.

In brief, this advantageous sill structure includes the following:

Brackets: One bracket is provided at each end of the sill, attached to the concrete slab with spiral concrete bolts attaching the system to the floor.

Cradle: The cradle sits in-between the two brackets anchored to the floor. This cradle bolts directly to the brackets, in slotted holes offering both horizontal and vertical adjustability. Once properly positioned, jack bolts are installed at precise locations within the cradle.

Sill: The sill is bolted to the cradle, in slotted holes further enhancing adjustability. The system is designed to accept all available sill materials, including a stainless steel sill.

This method and structure known by the trademark Quicksill ™ has the following advantages:

1. It can be used whether a building is built using concrete or steel as the method of structural support.
   a. The extra cost and imprecision of a sill support pocket in a concrete building is avoided.
   b. The inconveniences of working from a running platform to mount a sill support angle in a steel building is avoided.
2. The Quicksill ™ assembly is so rigid that no grout is required underneath the sill to keep it from deflecting, whereby the doors could pop out. This saves an entire step in the building process.
3. The Quicksill ™ structure provides a sturdy "bottom" to an entrance assembly that will allow more components to be preassembled in the factory. This will speed up field installation and allow elevator construction companies to complete their work earlier.
4. The complete elevator sill assembly can be installed from the hall for the first time. This provides:
   a. Faster progress for the installation of the rest of the elevator system,
   b. Safety benefits as the elevator shaft can be enclosed more quickly,
   c. Cost savings from not requiring a platform operator to install material from inside the shaft.

An elevator entrance consists of many components, a frame, one or more doors, a sill, a header, two struts and miscellaneous mounting brackets which combined can weigh more than 400 pounds. In order to allow the door to slide, the elevator entrance has to be mounted inside the shaft—clear of the wall that divides the shaft from the hallway where people wait for the elevator.

The present invention provides a three piece assembly that supports all the entrance components and is the first item installed in the process of entrance erection. The three assembly pieces, a sill, a pair of end brackets and the support cradle which extends between he brackets, may be shipped assembled from the factory with the adjustment hardware hand-tightened. Standing in the hallway, the installers locate this sill assembly in the center of the entrance opening and then place the assembly on the edge of the elevator shaft so the cradle is suspended between the ends by the brackets inside the shaft. The concrete is drilled, cement anchors are put in the holes, and flat-head screw sleeves are used to fasten the assembly to the hallway floor. Then, if the sill has not been installed in the factory, it is mounted on the cradle. The sill is leveled and positioned properly and the adjustment hardware is machine tightened to lock it in place. The adjustment process includes screws tightened against the side of the slab to minimize rotation and screws tightened underneath the cradle to keep it from slipping. Once all adjustment is complete further entrance installation may proceed.

Elevator entrances must be aligned very carefully to the rails and no part of the entrance is more critical than the sill. The elevator door sill assembly of the present invention provides structures with a variety of slots and hardware to allow the sill to be adjusted in all planes with a very wide range of motion. Extension brackets can also be easily added to expand the range of motion without adverse effect on the structural strength. This elevator sill assembly and installation method incorporates a design feature to facilitate the work of other trades as they relate to the entrance. Slots punched in the edge that sits atop the floor slab allow carpenters to easily fasten drywall track to the floor if the entrance is being installed in a sheetrock wall.

This invention relates to a highly advantageous, novel and cost saving way of solving a difficult and expensive problem in the structure and installation and leveling of an elevator sill. The assembly structure and installation is one of simplicity and ease of installing from the hallway. The structure consists of only three major components, a sill, a cradle for the sill and a pair of brackets for supporting the cradle and sill from the hall floor.

The elevator door sill assembly is installable from a hallway without the use of a moving elevator platform, A pair of spaced generally L-shaped end brackets are provided for attachment to the hall floor of an elevator entrance A vertically adjustable sill cradle is supported at its end portions by the brackets and a horizontally and vertically adjustable sill is mounted on the sill cradle. Adjustment means are provided on the brackets which allow the cradle to be leveled and to be adjusted so that the cradle level conforms to the hall floor.

The elevator door sill cradle is adjustable vertically by means of fasteners that are moveable in vertical slots in the end brackets. The elevator door sill is horizontally adjustable on the cradle by means of fasteners that are moveable in horizontal slots provided in the cradle. The elevator door sill assembly brackets are L-shaped with a vertical cleat extending therefrom toward the interior of the elevator shaft. The cleats have vertical slots formed therein. The elevator door sill assembly has off set clips that are mounted on the sill and are attached to the lower ends of a pair of elevator jamb vertical posts. The elevator door sill assembly has the pair of vertical elevator entrance supports on opposite sides of the pair of vertical elevator door posts which are adjustably attached to the brackets.

The method of installing an elevator door sill assembly without using a moving elevator platform in which the assembly is installed from the hallway and viewed from the hallway has the following steps:

a. The hall floor adjacent to the elevator shaft door entrance is prepared by the placement of anchors therein to position and fasten a pair of spaced support brackets,
b. Support brackets are fastened to the flat horizontal floor of the hall by the anchors and spaced apart so as to support opposite ends of a sill,
c. A vertically adjustable sill cradle is attached at opposite ends to the support brackets,
d. A sill is attached to the top side of the cradle,
e. The cradle is vertically adjusted relative to the brackets so that the sill is leveled with the hall floor,
f. The sill is horizontally moved by means of adjustable fasteners so that the sill is properly placed between the elevator hall and the elevator floor.

The brackets are provided with vertical slots and cradle fasteners are moved up and down vertically to level the carriage and sill. The cradle is provided with horizontal slots for sill fasteners and horizontally adjusting the sill by adjusting the sill fasteners so that the sill is properly aligned between the elevator hall and the elevator floor.

Accordingly the advantages of the elevator entrance sill structure and installation method include:

1. Ability to adapt to changing field condition. Attachment to floor offers a more consistent surface than shaft walls, thus eliminating chopping to facilitate proper wall bracket placement.
2. Does not require moving platform for installation. Should the elevator be shut down, work can continue on entrance installation while repairs are in progress.

Enables multitasking or second shift entrance installation without affecting ongoing car top operations.

3. Mounts from hall side as well as shaftway. Versatility is what this system is based on.
4. Increased horizontal and vertical adjustability of sill. Easily adjustable both in and out and up and down, via adjustment hardware. No relocating of attachment brackets.
5. Groutless from inside the shaft. Quicksill ™ is easily grouted in from the hall side of the entrance. The supplied grout stop 15 A presses into place, and rests on jack bolts, creating a pocket that is filled by approximately 10 pounds of concrete mix 15.
6. Unaffected by poor shaftway wall construction. Deviations to shaft walls no longer require costly chopping at bracket location points.
7. Enables multitasking within single shaft. With proper protection, car platform can be positioned as to facilitate installation of cab or other work concurrently with entrance installation.

SUMMARY DESCRIPTION OF AN ALTERNATE EMBODIMENT AND INSTALLATION METHOD FOR A HINGED ELEVATOR SILL ASSEMBLY

An elevator entrance consists of many components, a frame, one or more doors, a sill, a header, two struts and miscellaneous mounting brackets which combined can weigh more than 400 pounds. In order to allow the door to slide, the elevator entrance has to be mounted inside the shaft—clear of the wall that divides the shaft from the hallway where people wait for the elevator.

The present invention provides a three piece assembly that supports all the entrance components and is the first item installed in the process of entrance erection. The three assembly pieces, a sill, an alignment hinge and the support cradle with two assembly hinge brackets, may be shipped assembled from the factory with the adjustment hardware hand-tightened.

The installers set the location of the alignment hinge based on the elevator rails. They fasten the alignment hinge to the floor. Separately, the sill is positioned to the correct location atop the sill assembly. The sill assembly is then attached to the alignment hinge by means of the assembly hinge brackets. The sill assembly is rotated into the shaft and measured, and then retracted firom the shaft for final adjustments. The assembly is rotated back into the shaft and the assembly hinge brackets permanently fastened to the floor. The alignment hinge is detached from the sill assembly and removed from the floor, and the remaining tasks of entrance assembly proceed.

The adjustment process includes screws tightened against the side of the slab to minimize rotation and screws tightened underneath the assembly to keep it from slipping. Once all adjustment is complete further entrance installation may proceed.

Elevator entrances must be aligned very carefully to the rails and no part of the entrance is more critical than the sill. The elevator door sill assembly of the present invention provides structures with a variety of slots and hardware to allow the sill to be adjusted in all planes with a very wide range of motion. Extension brackets can also be easily added to expand the range of motion without adverse effect on the structural strength. This elevator sill assembly and installation method incorporates a design feature to facilitate the work of other trades as they relate to the entrance. Slots punched in the edge that sits atop the floor slab allow carpenters to easily fasten drywall track to the floor if the entrance is being installed in a sheetrock wall.

This invention relates to a highly advantageous, novel and cost saving way of solving a difficult and expensive problem in the structure and installation and leveling of an elevator sill. The assembly structure and installation is one of simplicity and ease of installing from the hallway. The structure consists of only three major components, a sill, a sill assembly with assembly hinge brackets to support the sill assembly and sill from the hall floor and an alignment hinge.

The elevator door sill assembly is installable from a hallway without the use of a moving elevator platform, A pair of spaced generally L-shaped hinged brackets are provided for attachment to the hall floor of an elevator entrance A vertically adjustable sill assembly is supported at its end portions by the brackets and a horizontally and vertically adjustable sill is mounted on the sill cradle. Adjustment means are provided on the hinged brackets which allow the cradle to be leveled and to be adjusted so that the cradle level conforms to the hall floor.

The elevator door sill assembly is adjustable vertically by means of fasteners that are moveable in vertical slots in the end hinged brackets. The elevator door sill is horizontally adjustable on the assembly by means of fasteners that are moveable in horizontal slots provided in the cradle. The elevator door sill assembly hinged brackets are L-shaped with a vertical cleat extending therefrom toward the interior of the elevator shaft. The cleats have vertical slots formed therein. The elevator door sill assembly has off set clips that are mounted on the sill and are attached to the lower ends of a pair of elevator jamb vertical posts. The elevator door sill assembly has the pair of vertical elevator entrance supports outside of the pair of vertical elevator entrance posts which are adjustably attached to the brackets.

The method of installing an elevator door sill assembly without using a moving elevator platform in which the assembly is installed from the hallway and viewed from the hallway has the following steps:

a. Measurements are taken of the position of the elevator rails relative to the hall floor to determine the location of the components of the assembly.
b. The hall floor adjacent to the elevator shaft door entrance is prepared by the placement of anchors therein to position and fasten an alignment hinge,
c. The alignment hinge is fastened to the flat horizontal floor of the hall by removable anchors and located so as to accurately position the sill, when installed.
d. The hinged brackets of a vertically adjustable sill assembly are attached at opposite ends to the alignment hinge,
e. The assembly is vertically adjusted relative to the brackets so that the sill is leveled with the hall floor,
f. The sill is horizontally moved by means of adjustable fasteners so that the sill is properly placed between the elevator hall and the elevator floor.

The assembly hinge brackets are provided with vertical slots and cradle fasteners are moved up and down vertically to level the carriage and sill. The assembly is provided with horizontal slots for sill fasteners and horizontally adjusting the sill by adjusting the sill fasteners so that the sill is properly aligned between the elevator hall and the elevator floor.

Accordingly the advantages of the elevator entrance sill structure and installation method include:

1. Ability to adapt to changing field conditions. Attachment to floor offers a more consistent surface than shaft walls, thus eliminating chopping to facilitate proper wall bracket placement.

2. Does not require moving platform for installation. Should the elevator be shut down, work can continue on entrance installation while repairs are in progress. Enables multitasking or second shift entrance installation without affecting ongoing car top operations.
3. Mounts from hall side as well as shaftway. Versatility is what this system is based on.
4. Increased horizontal and vertical adjustability of sill. Easily adjustable both in and out and up and down, via adjustment hardware. No relocating of attachment brackets.
5. Groutless from inside the shaft.

Quicksill ™ is easily grouted in from the hall side of the entrance. The supplied grout stop 15 A presses into place, and rests on jack bolts, creating a pocket that is filled by approximately 10 pounds of concrete mix 15.

6. Unaffected by poor shaftway wall construction. Deviations to shaft walls no longer require costly chopping at bracket location points.
7. Enables multitasking within single shaft. With proper protection, car platform can be positioned as to facilitate installation of cab or other work concurrently with entrance installation.

DETAILED DESCRIPTION OF THE INVENTION

Figure 1:
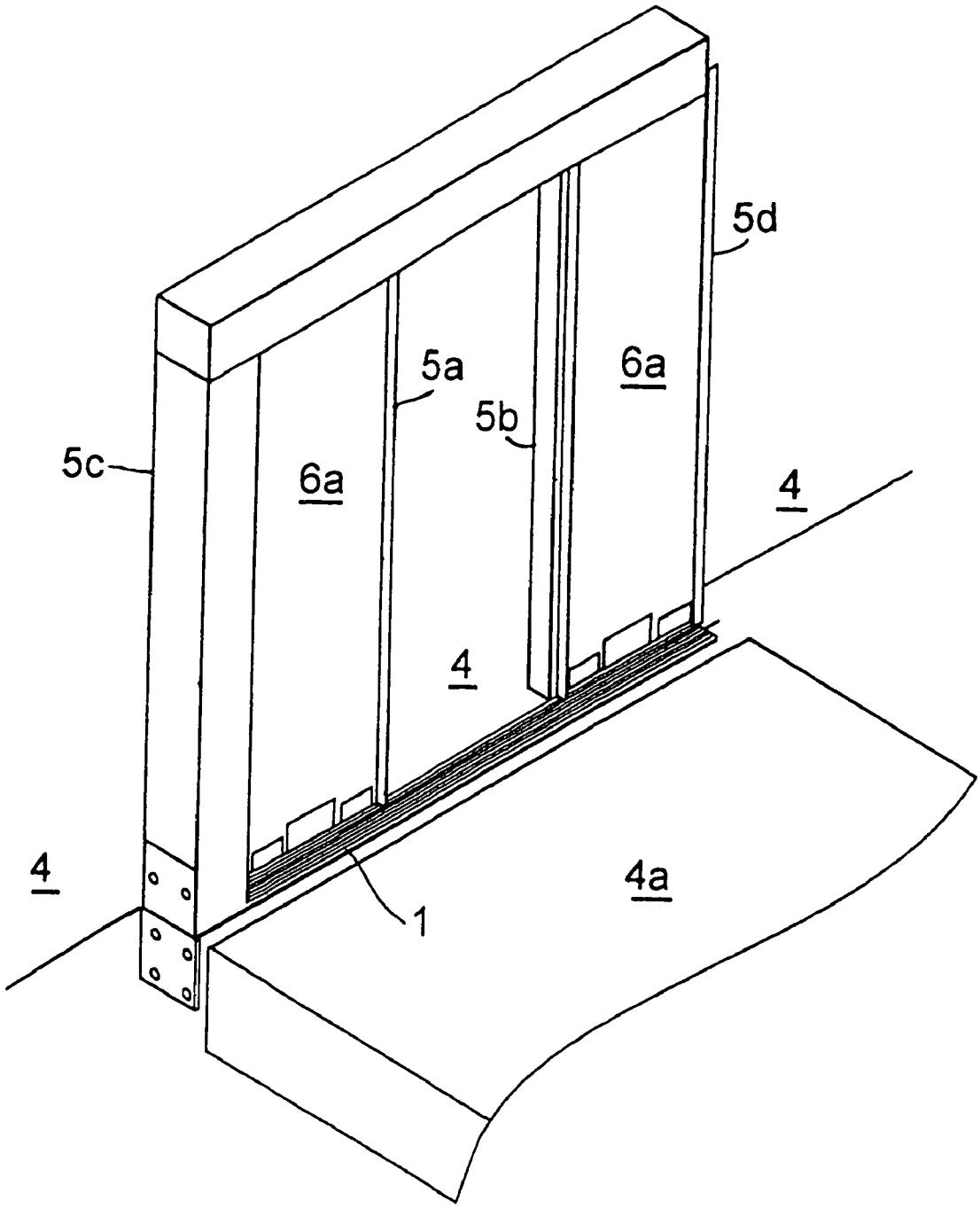
FIG. 1 is a partial perspective view of the elevator entrance from the inside of the elevator with the doors open to the hall.
Figure 2:
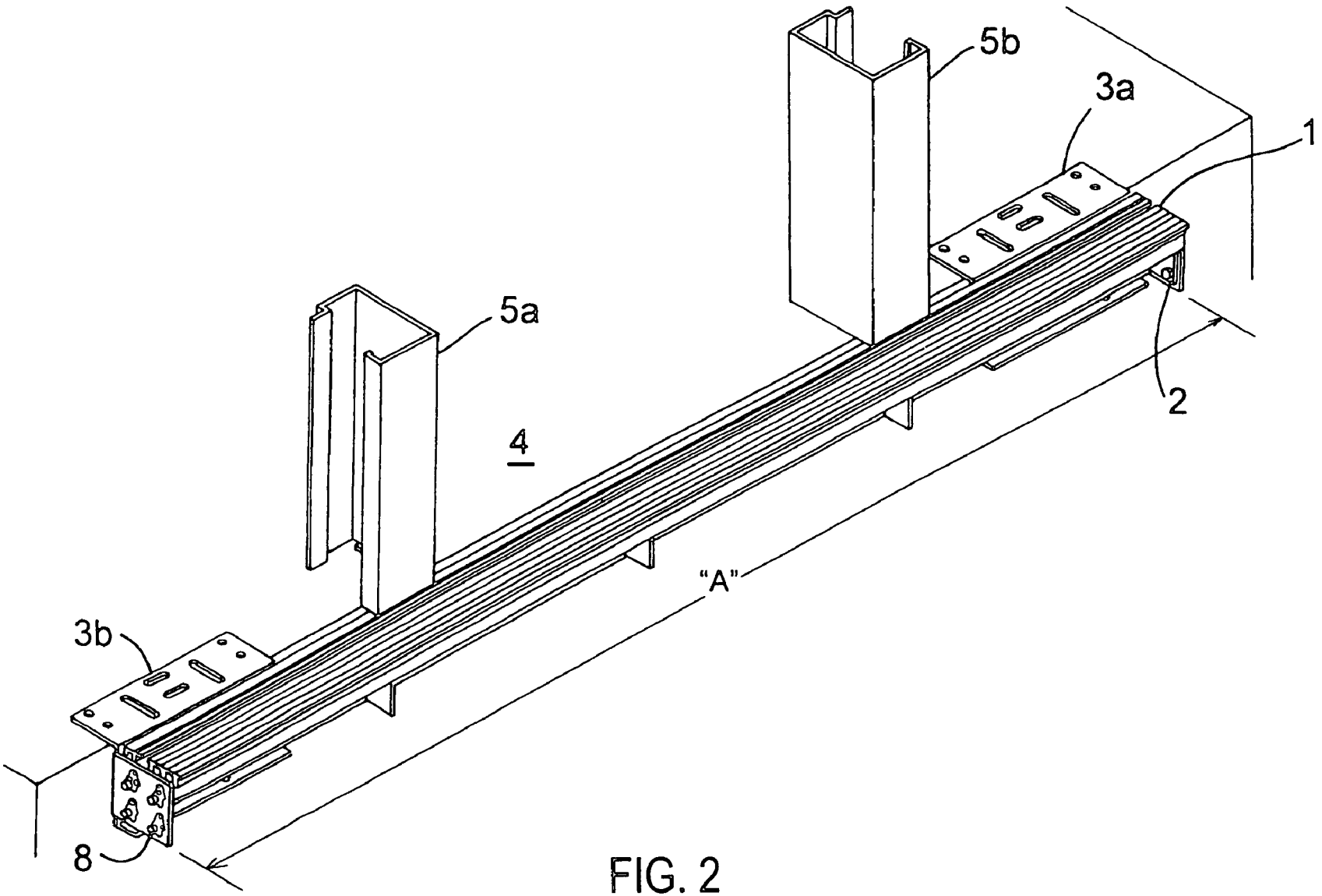
FIG. 2 is a perspective view of the elevator door sill assembly of the present invention.
Figure 3:
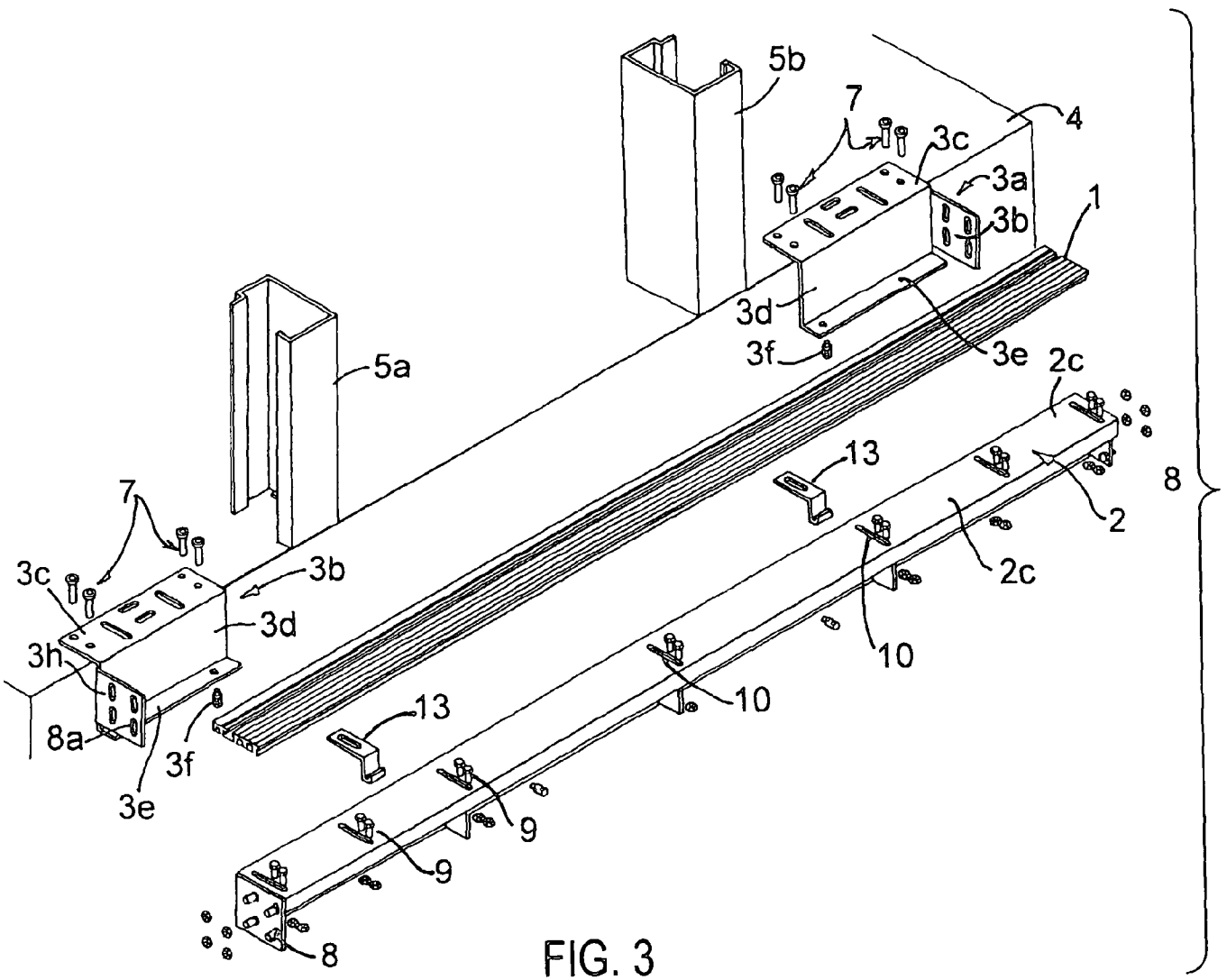
FIG. 3 is an expanded perspective view of elevator door sill assembly of FIG. 2.

The elevator door entrance sill assembly of the present invention is attached to the building hall floor 4 forming the elevator door opening. As illustrated in FIGS. 1, 2 and 3, the sill assembly includes a sill 1 mounted on a support cradle 2. The sill is for a sliding elevator door that rides in a track in the sill. At opposite ends, the cradle 2 is supported and attached to the building floor by shaped end adjustable support brackets 3*a* and 3*b* which provide shoe like support for the cradle 2. The adjustable support brackets 3*a* and 3*b* are mounted on the building floor 4 at either side of the elevator vertical door frames 5*a* and 5*b*. Outer vertical supports 5*c* and 5*d* form the structure for the elevator entrance as shown in FIG. 1. The sliding elevator doors 6 are in an open position to provide access from the elevator floor area 4*a* to the building hall floor 4.

Figure 4:
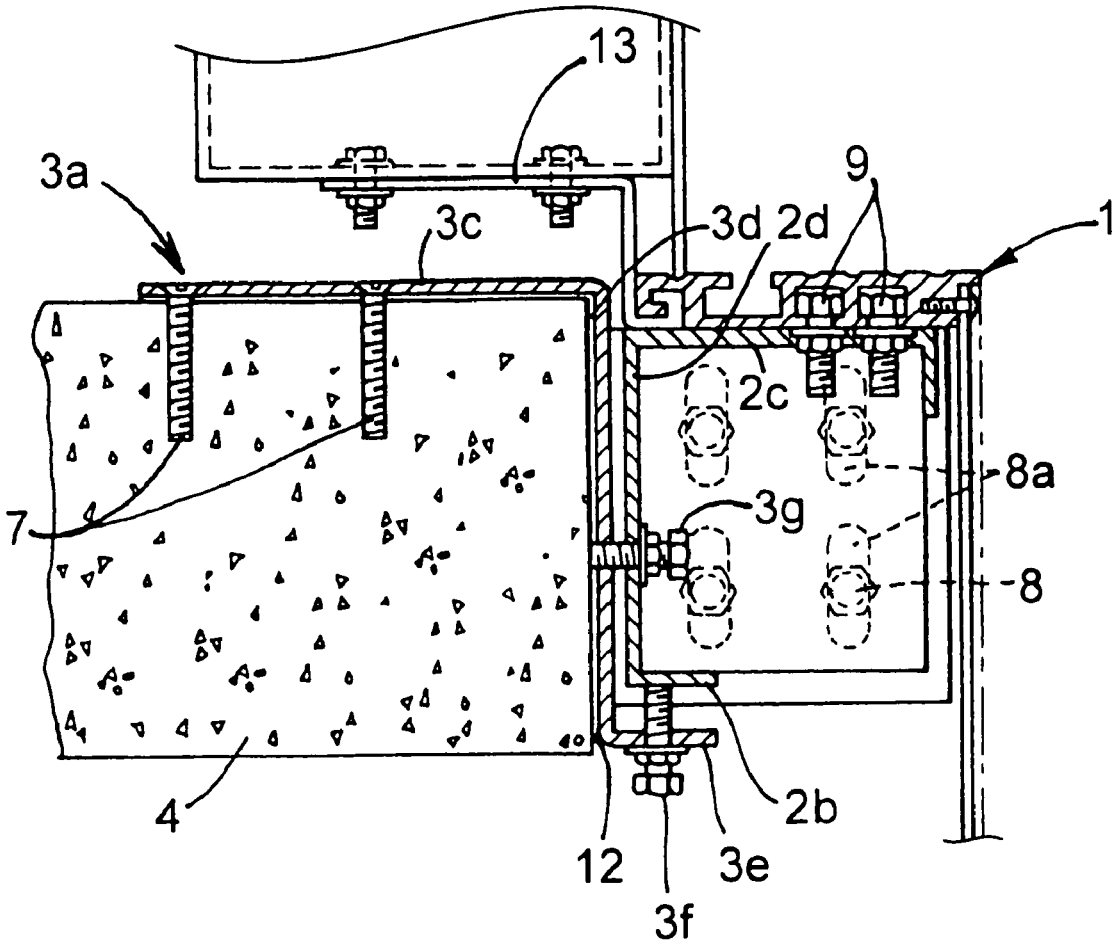
FIG. 4 is a cross-sectional view of the hall floor, the support bracket, sill and sill cradle at one end of the assembly.
Figure 5A:
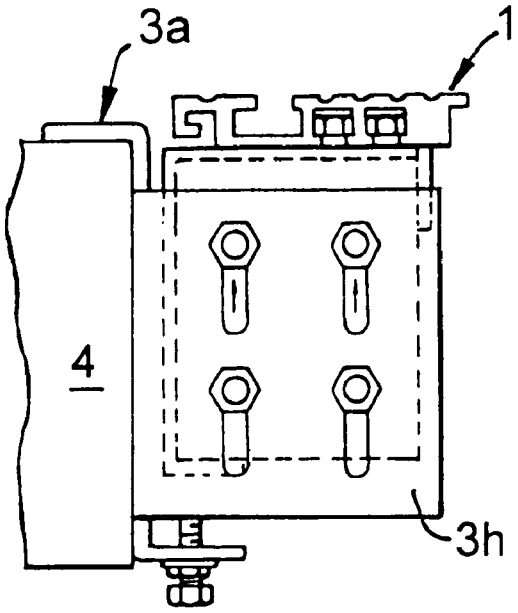
FIG. 5*a* is an end view of the support bracket illustrating an upward adjustment in the position of the cradle and sill.
Figure 5B:
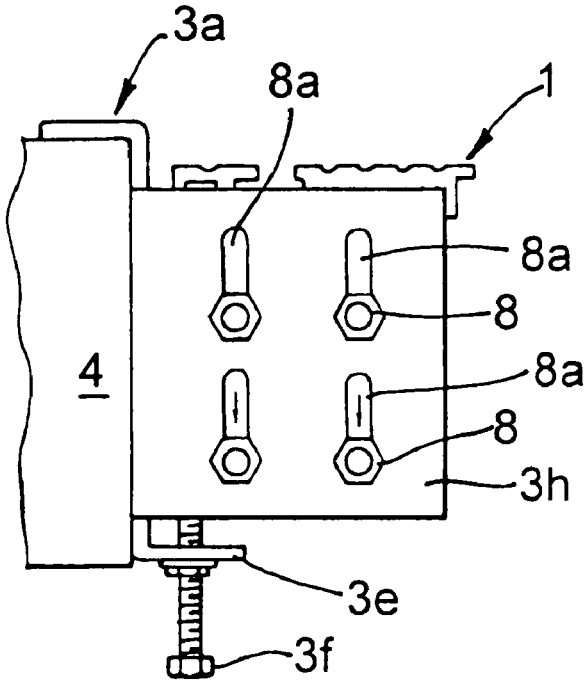
FIG. 5*b* is an end view of the opposite bracket on the other end of the assembly illustrating a downward adjustment of the cradle and sill.

As illustrated in FIGS. 2, 3 and 4, the sill cradle 2 is bolted at opposite ends to the brackets 3*a* and 3*b* by means of adjustable cradle fastener bolts 8 which allow for up and down vertical adjustment of the cradle 2 and sill 1 for leveling the sill. The adjustable movement is provided for by the vertical slots 8*a* provided in the shoulder portion 3*h* of the brackets 3*a* and 3*b*. The sill 1 in turn is bolted to the top of the cradle with adjustable fastener bolts 9 and brackets 13. The cradle 2 is provided with multiple slots 10 to allow horizontal adjustment of the sill 1 and the cradle 2 relative to the building floor 4 and the elevator floor 4*a*.

In the cross-section of FIG. 4 the sill assembly is illustrated with adjustable bracket 3*a* bolted into the concrete floor 4 with sleeve anchors 7. The advantageous structure of the end brackets 3*a* and 3*b* is illustrated in FIGS. 3 and 4. The brackets 3*a* and 3*b* have a horizontal portion 3*c* bolted to the hall floor 4 by anchors 7. A vertical portion 3*d* of the L-shaped brackets 3 extends downward along the inside face of the elevator shaft wall 12. The brackets 3 have a horizontal ledge portion 3*e* which extends from the lower edge of the vertical portion 3*d* to provide support for the sill cradle 2. An adjustable threaded screw 3*f* is provided for vertical adjustment of the cradle 2 in cooperation with the adjustable bolts 8 and complementary slots 8*a* provided on the brackets 3*a* and 3*b*. An additional bolt 3*g* may be provided to also give support to the cradle 2 by attaching the cradle vertical portion 2*b* to the vertical bracket portion 3*d*. These cradle bolts 3*g* are placed after the vertical adjustment of the cradle 2 has been completed.

The cradle 2 illustrated in FIGS. 3 and 4 is also generally L-shaped with vertical portion 2*b* and horizontal portion 2*c*. Bolts 9 connect the sill 1 to the cradle 2 through adjustment horizontal slots 10 in the horizontal portion 2*c* which allow the sill to be adjusted horizontally relative to the hall floor 4 and the elevator floor 4*a*.

Figure 6A:
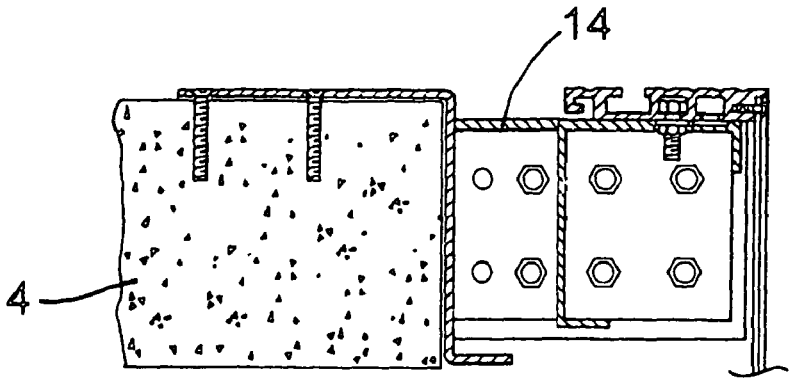
FIG. 6*a* is a cross-sectional view of a bracket with an extension plate in place.
Figure 6B:
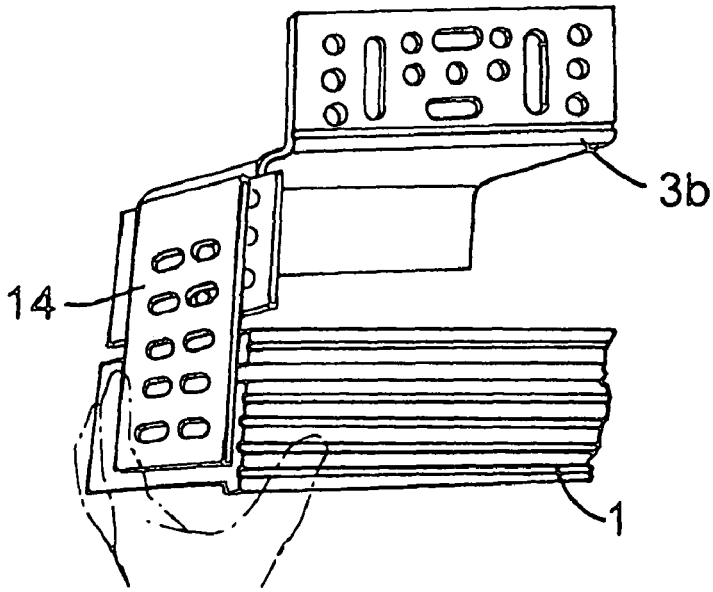
FIG. 6*b* is a top view of a bracket with an extension plate.
Figure 6C:
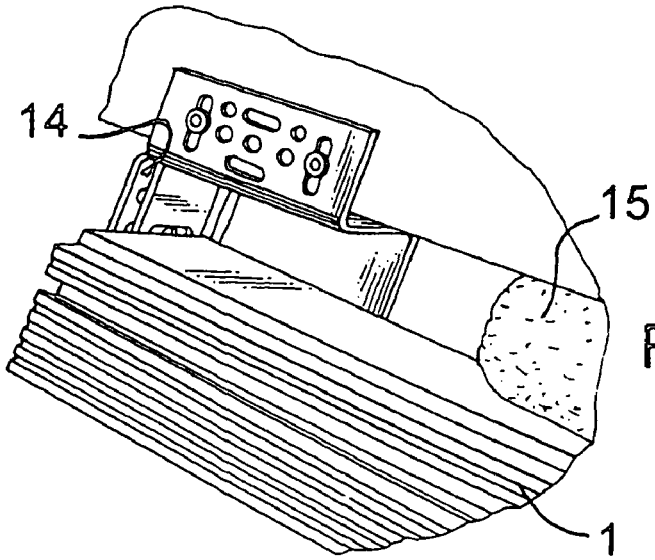
FIG. 6*c* is a top view of a bracket with an extension plate being installed.

As disclosed in FIGS. 6*a*, 6*b* and 6*c* horizontal extension plates 14 may be used to extend the sill into the elevator shaft away from the building floor slab 4. The elevator plates have holes to receive appropriate bolts to attach the plates 14 to the brackets 3*a* and 3*b* and to opposite ends of the support cradle 2. In effect the plates 14 are extension of the shoulder portions 3*h* of the brackets 3*a* and 3*b*.

As shown in FIG. 6*c*, grout 15 may be placed between the slab 4 and the cradle 2.

DETAILED DESCRIPTION OF ALTERNATE EMBODIMENT WITH A HINGED ELEVATOR DOOR SILL ASSEMBLY AND METHOD OF INSTALLATION

An alternate embodiment with a hinged elevator door sill assembly and method installation is illustrated in FIGS. 7, 8, 9*a* and 9*b*. The elevator door entrance sill assembly of the present invention is attached to the building hall floor 4 forming the elevator door opening. As illustrated in FIGS. 7, 8, 9*a* and 9*b*, the sill assembly includes a sill 1 mounted on a sill assembly cradle 2. The sill is for a sliding elevator door that rides in a track in the sill. At opposite ends, the cradle 2 is supported and attached to the building floor by shaped end assembly hinge brackets 3*a* which provide shoe like support for the cradle 2. The adjustable support brackets 3*a* are mounted on the building floor 4 at either side of the elevator vertical jamb members 5*a* and 5*b*. Outer vertical supports 5*c* and 5*d* form the structure for the elevator entrance as shown in FIG. 1. The sliding elevator doors 6 are in an open position to provide access from the elevator floor area 4*a* to the building hall floor 4.

As shown in FIGS. 7, 8, 9*a* and 9*b*, an alignment hinge bracket 13*b* is fastened to the building hall floor 4 using removable fasteners 17. This is done through the horizontal slots 16, which allow the alignment hinge bracket 13*b* to be moved perpendicular to the edge of the building hall floor 4 until it is in the correct position, at which time the removable fasteners 17 are tightened. The alignment hinge bracket 13*b* comes with the alignment hinge leaf 35*a* preassembled by means of removable fasteners 11.

Figure 8:
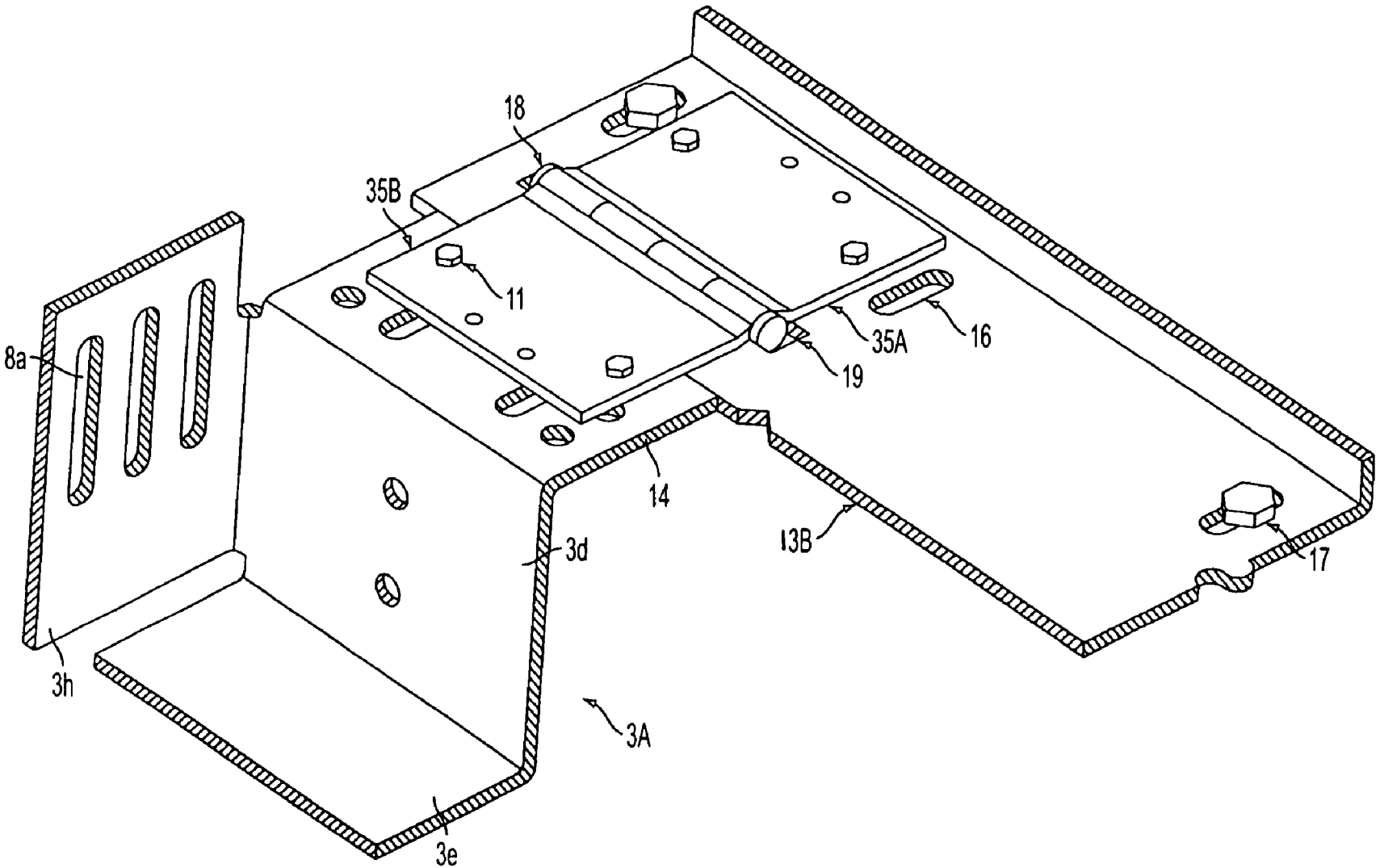
FIG. 8 is a perspective view of a bracket and hinge.

FIG. 8 shows how the assembly hinge leaf 35*b* is attached to the assembly hinge bracket 3*a* by means of removable fasteners 11. The assembly hinge bracket 3*a* comes preassembled to the sill assembly (including sill 1 and cradle 2).

Figure 9B:
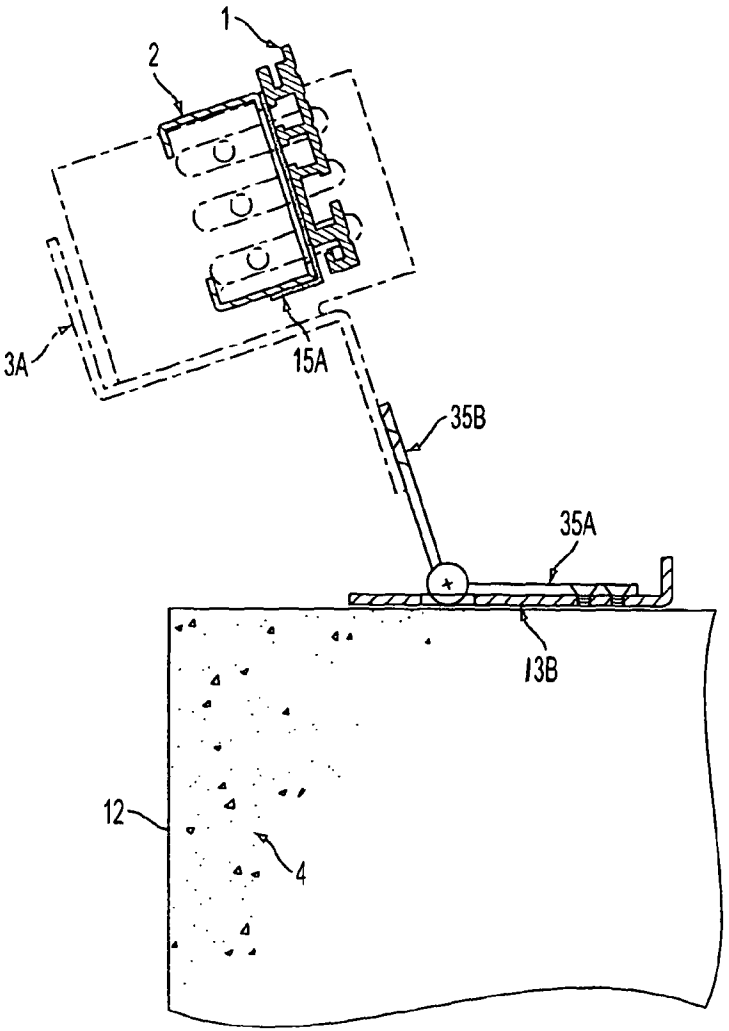
FIG. 9*b* is a cross sectional view of the hall floor, the elevator entrance sill assembly and alignment hinge bracket, wherein the sill assembly is shown rotated out of the shaft.
Figure 9A:
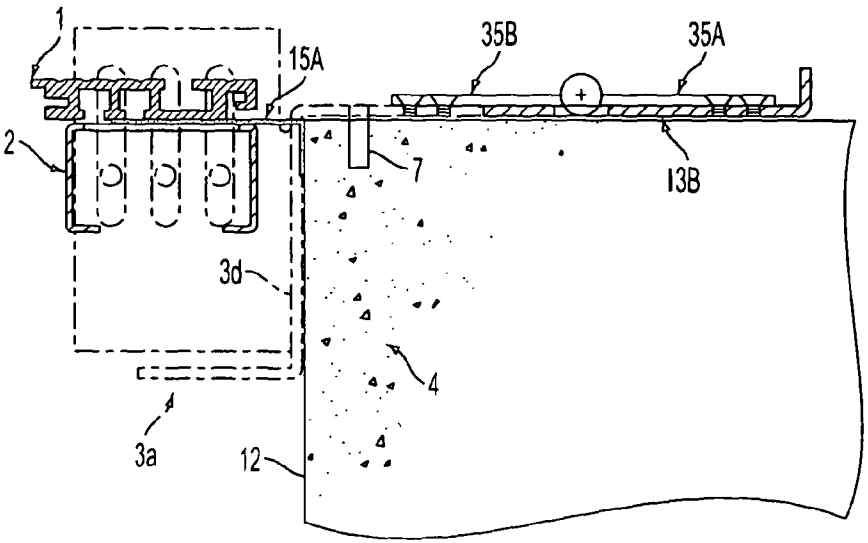
FIG. 9*a* is a cross sectional view of the hall floor, the elevator entrance sill assembly, and the alignment hinge bracket, wherein an elevator entrance sill assembly is shown rotated into the shaft.

In FIGS. 7, 8, 9*b*, and 9*a*, the connection between the alignment hinge bracket 13*b* and the assembly hinge bracket 3*a* is shown. They are brought together as shown in FIGS. 8, 9*a* and 9*b*. The assembly hinge bracket 3*a*, and all parts attached to it may be rotated in and out of the shaft as shown in FIGS. 9*a* and 9*b*. The hinge knuckle slot 19 allows both the alignment hinge bracket 13*b* and the assembly hinge bracket 3*a* to be laid flush against the building hall floor 4, which provides a stable connection in establishing the proper height of sill 1.

There are similarities in the sill and adjustable cradle shown in FIG. 1 to 6 of the previous embodiment. As illustrated in FIGS. 7, 8, 9*a* and 9*b*, the sill cradle 2 is bolted at opposite ends to the brackets 3*a* by means of adjustable cradle fastener bolts 8 which allow for up and down vertical adjustment of the cradle 2 and sill 1 for leveling the sill. The adjustable movement is provided for by the vertical slots 8*a* provided in the shoulder portion 3*h* of the brackets 3*a* and 3*b*. The sill 1 in turn is bolted to the top of the cradle with adjustable fastener bolts 9. The cradle 2 is provided with multiple slots perpendicular to its long axis to allow horizontal adjustment of the sill 1 and the cradle 2 relative to the building floor 4 and the elevator floor 4*a*.

In the cross-section of FIG. 9*b* the sill assembly is illustrated with adjustable bracket 3*a*. The advantageous structure of the end brackets 3*a* is illustrated in FIGS. 7, 8 9*a* and 9*b*. A vertical portion 3*d* of the L-shaped brackets 3*a* extends downward along the inside face of the elevator shaft wall 12. The brackets 3*a* have a horizontal ledge portion 3*e* which extends from the lower edge of the vertical portion 3*d* to provide support for the sill cradle 2. An adjustable threaded screw 3*f* is provided for vertical adjustment of the cradle 2 in cooperation with the adjustable bolts 8 and complementary slots 8*a* provided on the brackets 3*a* and 3*b*. As shown in the similar structures of FIG. 3 an additional bolt 3*g* may be provided to also give support to the cradle 2 by attaching the cradle vertical portion 2*b* to the vertical bracket portion 3*d*. As shown in FIG. 4 these cradle bolts 3*g* are placed after the vertical adjustment of the cradle 2 has been completed.

Figure 7:
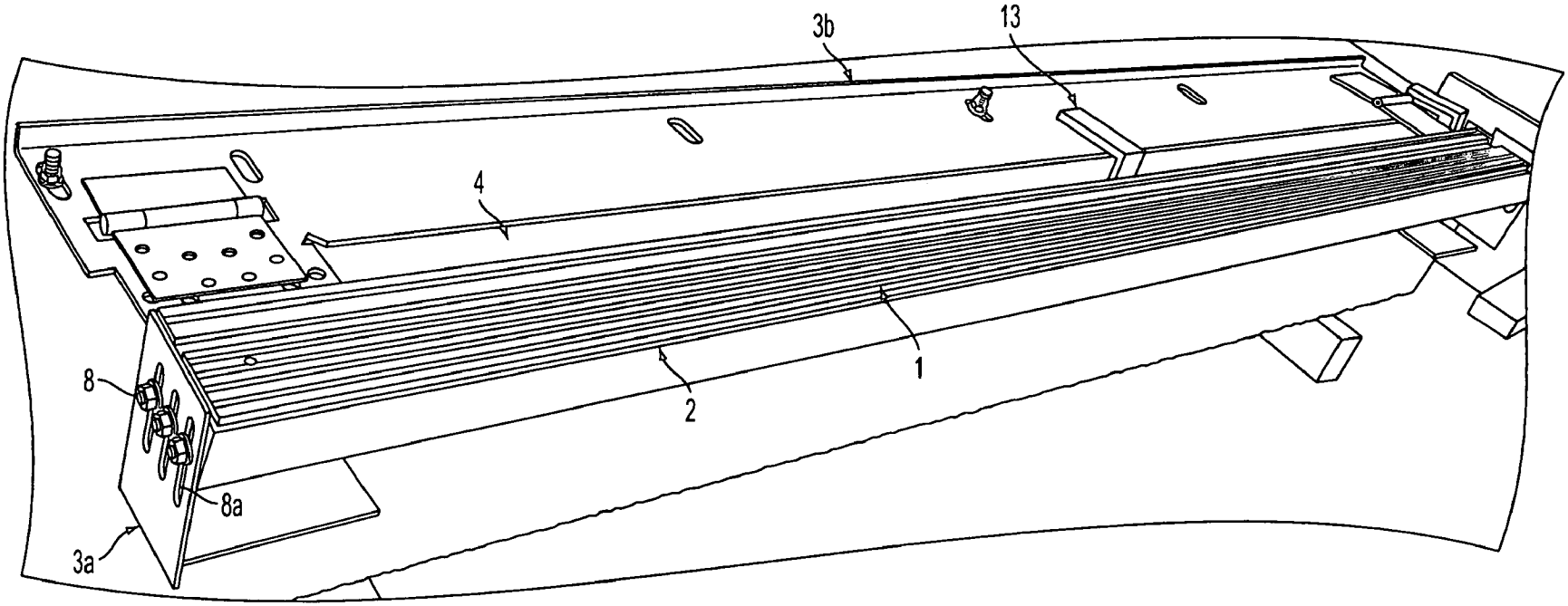
FIG. 7 is a perspective of the alternate door sill assembly.

The cradle 2 illustrated in FIGS. 7, 8*a* and 9*b* is also generally L-shaped with vertical portion 2*b* and horizontal portion 2*c*. As shown in similar structures of FIG. 4, bolts 9 connect the sill 1 to the cradle 2 through adjustment horizontal slots in the horizontal portion 2*c* which allow the sill to be adjusted horizontally relative to the hall floor 4 and the elevator floor 4*a*.

As disclosed in FIG. 8 horizontal extension plates 14 are used to extend the sill into the elevator shaft away from the building floor slab 4. The elevator plates have holes to receive appropriate bolts to attach the plates 14 to the bracket portion 3*a* to opposite ends of the support cradle 2. The plates 14 are extension of the shoulder portions 3*h* of the bracket 3*a*.

After all necessary adjustments have been made to align the sill 1 and the sill assembly cradle 2, they are permanently held in place by attaching the horizontal portion 14 of FIG. 8 and 3*c* of FIG. 3 of the assembly hinge brackets to the hall floor 4 by anchors 7.

The assembly hinge leaf 35*b* may then be detached from the assembly hinge bracket 3*a* by removing the removable fasteners 11. Then removable fasteners 17 are taken out of the hall floor 4 and the alignment hinge bracket 13*b* is picked up, along with the alignment hinge leaf 35*a* and assembly hinge leaf 35*b*. This can then be moved to the next entrance and set in place while the next sill 1, sill assembly cradle 2 and assembly hinge brackets 3*a* are adjusted to the proper position as described above.

The invention claimed is:

1. An elevator entrance sill assembly installable from an outside of an elevator shaft at a building floor without the use of a moving elevator platform in the elevator shaft comprising:

an elevator entrance door sill adapted for mounting at an elevator shaft entrance adjacent to said elevator shaft; and hinge support means attachable to said elevator entrance door sill and mountable on the building floor adjacent to said elevator shaft and rotatable to extend upwardly from said floor and out of said elevator shaft;

wherein said elevator entrance door sill being attachable to said hinge support means while in an upward position and outside of said elevator shaft;

wherein said hinge support means and said elevator entrance door sill being rotatable downwardly to a horizontal position on said floor after attachment of said elevator door sill to said hinge support means with said elevator entrance door sill extending into said elevator shaft; and wherein said hinge support means comprises a hinge including a first leaf securely mounted on an alignment bracket spaced from said elevator entrance door sill and attached to said floor, and a second leaf mounted on a support bracket attached to and supporting said elevator entrance door sill and is rotatable with said support bracket between a vertical position and a horizontal position.

2. The elevator entrance sill assembly of claim 1 wherein said support bracket is securable to said floor with the elevator entrance door sill in the horizontal position extending into said elevator shaft and said hinge is removable for reuse.

3. An elevator entrance sill assembly installable from an outside of an elevator shaft at a building floor without the use of a moving elevator platform in the elevator shaft comprising:

an elevator entrance door sill adapted for mounting at an elevator shaft entrance adjacent to said elevator shaft; and hinge support means attachable to said elevator entrance door sill and mountable on the building floor adjacent to said elevator shaft and rotatable to extend upwardly from said floor and out of said elevator shaft;

wherein said elevator entrance door sill being attachable to said hinge support means while in an upward position and outside of said elevator shaft;

wherein said hinge support means and said elevator entrance door sill being rotatable downwardly to a horizontal position on said floor after attachment of said elevator door sill to said hinge support means with said elevator entrance door sill extending into said elevator shaft; and wherein said hinge support means comprises a hinge including a first leaf and a second leaf, said first leaf being mounted to an alignment bracket securable to said floor and spaced from said elevator entrance door sill, said second leaf being mounted on a support bracket which is attached to said elevator entrance door sill and rotatable with said second leaf and said elevator entrance door sill from a vertical position outside said elevator shaft to a horizontal position with said elevator entrance door sill supported in said elevator shaft.

4. The elevator entrance sill assembly of claim 3 wherein said support bracket is rotatable to a horizontal position and said support bracket being attachable to said floor to hold said sill assembly in the horizontal position at the door entrance, said alignment bracket being adapted to be removed for reuse with said first leaf secured to said floor.

5. The elevator door entrance sill assembly of claim 4 or claim 1 having a pair of spaced end brackets for attachment to said hinge support means, a vertically adjustable sill cradle supported at its end portions by said spaced end brackets, wherein said elevator entrance door sill is mounted on said sill cradle and is horizontally and vertically adjustable, adjustment means on said spaced end brackets allowing said cradle to be levelled and to be adjusted so that the cradle level conforms to the said floor when said hinge support means is in the horizontal position.

6. The elevator entrance sill assembly of claim 3 wherein said support bracket is adjustable in a horizontal direction from said hinge support means.

7. The elevator entrance sill assembly of claim 3 wherein said elevator entrance door sill is adjustable in a horizontal direction from said support bracket.

8. The elevator entrance sill assembly of claim 3 wherein said elevator entrance door sill is adjustable in a vertical direction.

* * * * *